US006817297B1

(12) United States Patent
Greene et al.

(10) Patent No.: US 6,817,297 B1
(45) Date of Patent: Nov. 16, 2004

(54) LOW-COST, NO-FRAGMENT EXPLOSIVE ACCESS TOOL

(75) Inventors: Michael L. Greene, Fort Washington, MD (US); Jacob Tallman, Indian Head, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/672,587

(22) Filed: Sep. 29, 2003

Related U.S. Application Data

(62) Division of application No. 10/339,256, filed on Jan. 9, 2003.

(51) Int. Cl.[7] ..... F42B 1/00
(52) U.S. Cl. ..... 102/309; 102/306; 102/476
(58) Field of Search ..... 102/305, 306, 102/307, 308, 309, 310, 475, 476

(56) References Cited

U.S. PATENT DOCUMENTS 3,076,408 A * 2/1963 Poulter et al. ..... 89/1.14
3,176,613 A * 4/1965 Godfrey et al. ..... 102/306
3,374,737 A * 3/1968 Pike ..... 102/275.5
3,435,763 A * 4/1969 Lavine ..... 102/305
3,658,006 A * 4/1972 Nistler et al. ..... 102/307
3,896,731 A * 7/1975 Kilmer ..... 102/305
4,333,381 A * 6/1982 Boeglin et al. ..... 89/1.14
4,407,468 A * 10/1983 Bement et al. ..... 244/137.2
4,408,535 A * 10/1983 Alford ..... 102/305
4,628,819 A * 12/1986 Backofen et al. ..... 102/307
4,699,066 A * 10/1987 Eriksson ..... 102/305
4,905,601 A * 3/1990 Gabriel et al. ..... 102/307
5,149,911 A * 9/1992 Ringbloom et al. ..... 102/302
6,220,166 B1 * 4/2001 Cherry ..... 102/305

* cited by examiner

*Primary Examiner*—Teri Pham Luu
*Assistant Examiner*—T. Nguyen
(74) *Attorney, Agent, or Firm*—Mark Homer

(57) ABSTRACT

The invention comprises a device that uses a flexible material, preferably in a mostly square shape, having substantially orthogonal grooves scored into one side. An explosive charge, usually in the form of a sheet of explosives, is cut to fit the side opposite the grooves, in substantially the same shape as the grooves, without extending beyond the periphery of the flexible material. An initiating means is connected to the explosive charge so that upon initiation, the grooves focus the explosive charge so that a plurality of petals cantilevered are formed in the target material, substantially between the ends of the grooves, to define a fragment-free opening in the target material.

8 Claims, 6 Drawing Sheets

ENLARGED VIEW AT A-A

LOW-COST, NO-FRAGMENT EXPLOSIVE ACCESS TOOL

This application is a divisional of pending application Ser. No. 10/339,256, filed Jan. 9, 2003.

STATEMENT OF GOVERNMENT INTEREST

The invention described herein may be manufactured and used by or for the Government of the United States of America for governmental purposes without payment of any royalties thereon or therefor.

BACKGROUND OF THE INVENTION

1. Field of the Invention

The present invention pertains to the field of producing fragment-free access openings, more particularly to the field of using explosive material to produce fragment-free openings in hardened structures such as doors or metal containers and most particularly to the field of using explosive material to produce fragment-free openings in hardened containers that house improvised explosive devices without initiating said devices.

2. Description of the Related Art

Bomb squad technicians regularly deal with packages that are suspected of containing explosive devices. In order to reduce the risks associated with opening such packages, technicians primarily use either robotic tools or explosive access tools that can be initiated from a distance. For certain types of packages or containers, robotic access tools, which often lack precision, power, and are cumbersome, cannot be employed. For these types of packages, such as metal drums or other hardened containers, explosive access tools are the only option.

Various explosive tools have been employed for this purpose. One technique is to employ a linear-shaped charge to create an opening in the hardened container. These shaped charges comprise a chevron-shaped metallic casing, which is usually copper, aluminum, or lead, that contains a quantity of high explosive. The charge cuts the hardened container by accelerating each side of the chevron-shaped wedge into each other, forming a high-velocity metallic jet. However, this technique, like merely using high explosives to directly cut into hardened targets, produces many fragments, which are capable of accidentally initiating any improvised explosive device within the container.

In order to alleviate this fragmentation problem, a device commonly known as the Magic Cube™ was developed and disclosed in U.S. Pat. No. 6,220,166. This device comprises a sheet explosive that is initiated at four different points and a buffer material, made up of three sheets of stacked, low density material, such as polyethylene foam which is placed between the explosive and the target. Various types of tapes and adhesives are required in order to combine these elements and affix the final device to the target. While the device does alleviate the fragmentation problem discussed above under certain circumstances, it does have several problems associated with its intended use. First, due to the complexity of the device, any particular embodiment is designed to operate on only one range of specific "wall" thickness. Second, also due to the complexity of the device, it is relatively expensive. Third, the device only operates effectively against flat surfaces. Finally, the device only works against hardened materials, such as steel, but does not work against softer metals such as aluminum.

Therefore, it is desired to provide a an explosive access tool that produces no fragments, is inexpensive, and can be used on containers, made of varying materials, having various shapes and of varying wall thickness.

SUMMARY OF THE INVENTION

The present invention comprises an improved explosive access tool used by bomb squad technicians and others who require access to suspect packages and containers. The invention solves several problems associated with current tools along with using many materials already carried by bomb squad technicians in the field.

Accordingly, it is an object of this invention to provide an explosive access tool that creates fragment-free openings in target materials.

It is a further object of this invention to provide an explosive access tool that can be employed on non-flat surfaces.

A still further object of this invention is to provide an explosive access tool that is inexpensive compared to present explosive access tools.

A yet further object of this invention is to provide an explosive access tools that can be employed on targets of varying wall thickness.

This invention accomplishes these objectives and other needs related to creating fragment-free openings in target materials by providing a device that uses a flexible material, preferably in a mostly square shape, having substantially orthogonal grooves scored into one side. An explosive charge, usually in the form of a sheet of explosives, is cut to fit the side opposite the grooves, in substantially the same shape as the grooves, without extending beyond the periphery of the flexible material. An initiating means is connected proximately centrally to the explosive charge so that upon initiation, the grooves shape the explosive effect so that a plurality of petals cantilevered are formed in the target material, substantially between the ends of the grooves, to define a fragment-free opening in the target material.

A second embodiment of the invention, preferred for "softer" metal targets, such as aluminum, comprises a cutting plate, preferably made of a material harder than the target, that has deep narrow orthogonal grooves scored on a front side, or pre-punched petal edges formed by a press. These pre-punched petal edges may be heat-treated before being restored to an original flat configuration. A sheet of material, being softer than the cutting plate material, is placed over the grooves or edges. An explosive charge is placed on the sheet of material, positioned in substantial alignment with the grooves or edges on the sheet of material. The explosive charge preferably should not extend beyond the periphery of the sheet of material. Initiating means are used to initiate the explosive charge that creates an explosive force that drives the cutting plate into the target material, akin to the operation of a can-opener, creating a plurality of petals cantilevered from the target material to define a fragment-free opening in the target material.

Finally, the invention also comprises a method of using the device described herein to create an opening in a target material.

BRIEF DESCRIPTION OF THE DRAWINGS

The accompanying drawings, which are incorporated in and constitute a part of the specification, illustrate embodiments of the invention, and, together with the description, serve to explain the principles of the invention.

DESCRIPTION OF THE PREFERRED EMBODIMENT

Figures 1, 1A:
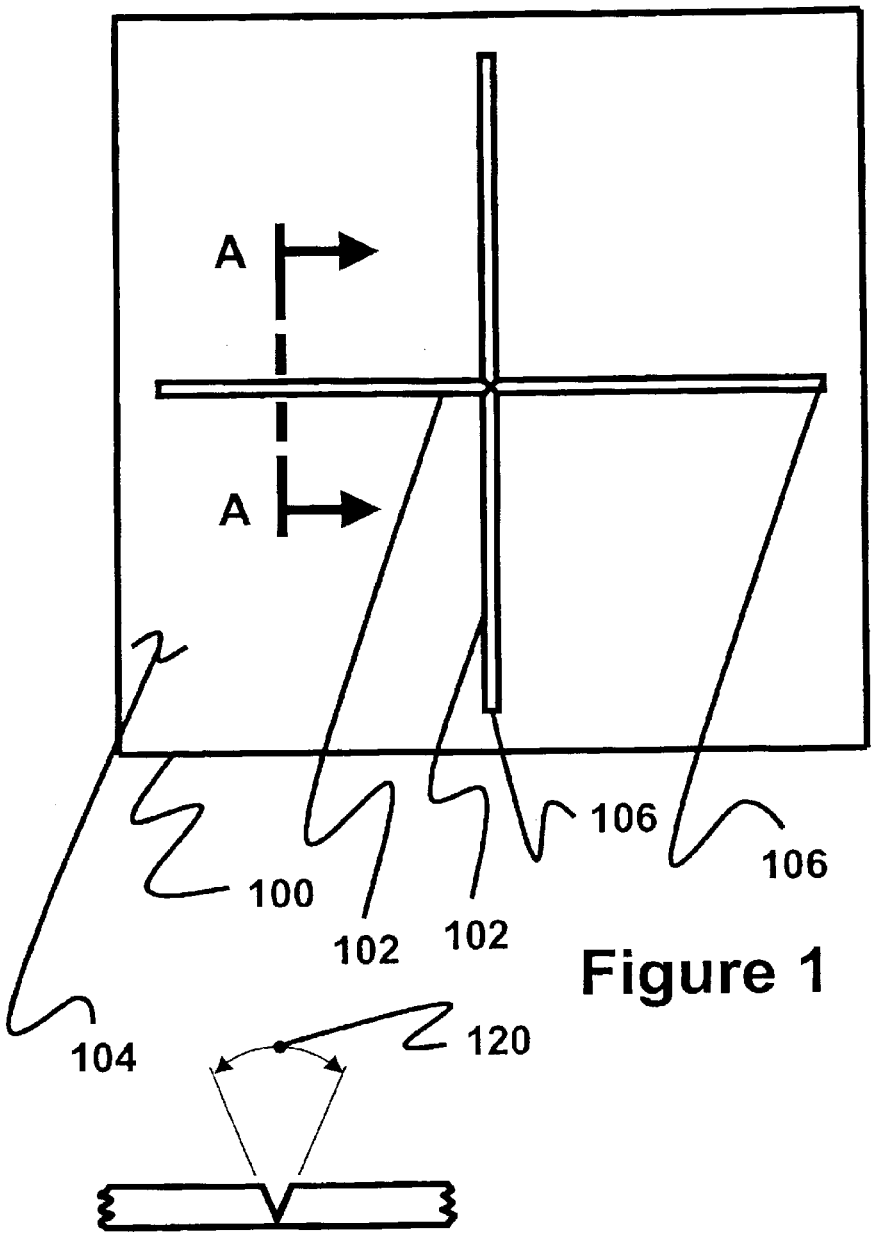
FIG. 1 is a bottom view of one side of an embodiment of the present invention.
FIG. 1*a* is a side view of cut-out AA from FIG. 1.
Figure 2:
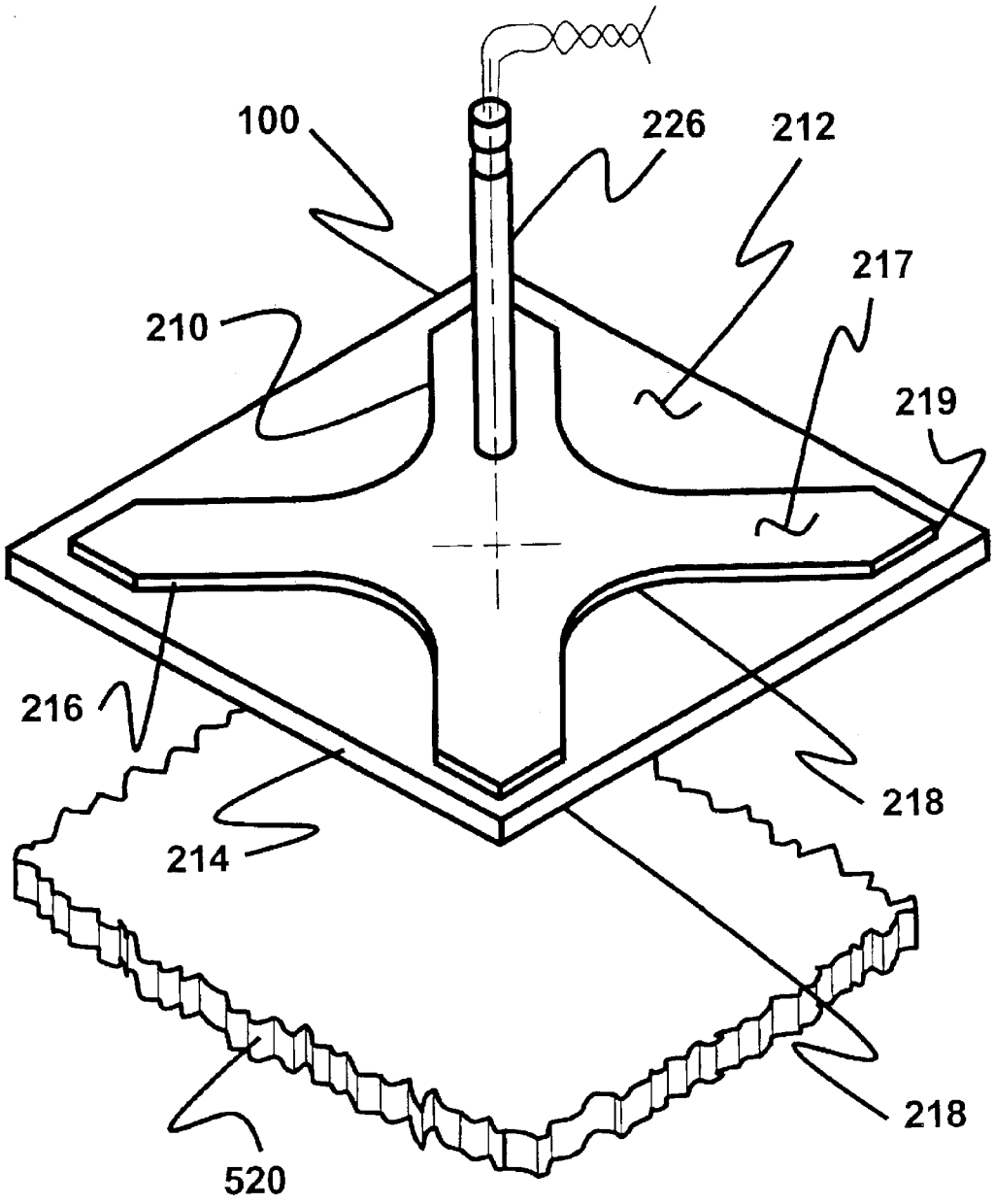
FIG. 2 is a top view of the opposite side of the embodiment set forth in FIG. 1.

The invention, as embodied herein, comprises an explosive access tool used to create fragment-free openings in target materials, often the walls of packages or containers suspected of containing improvised explosive devices (IEDs). The elements of the tool are made up of materials, many of which are already carried by bomb squad technicians, that are relatively inexpensive and light weight. In general, the invention comprises a flexible material that has two crossing grooves scored into one side. The term flexible, as it is used in this application, refers to a non-rigid material, capable of being flexed without the use of outside tools or machinery. Therefore, steel based materials would not be flexible, but materials such as polymeric materials or rubber materials would be flexible. Preferably, the grooves are positioned orthogonal to each other and do not extend to the periphery of the flexible material. An explosive charge, preferably in the form of a sheet of explosive, is placed on the side of the flexible material without the grooves, however, the explosive charge is substantially aligned with the grooves. The explosive charge preferably does not extend beyond the periphery of the flexible material. Initiating means are connected proximately central to the explosive in order to initiate the explosive. The grooves help focus the explosive force to penetrate the target material, creating a plurality of petals cantilevered from the target material, substantially between the ends of the grooves, to define a fragment-free opening in the target material.

Referring to FIGS. 1, 1*a*, 2, and 5, the flexible material 100, has two crossed grooves 102 scored on a first side 104. An explosive charge 210 is placed on the second side 212 of the flexible material 100. The explosive charge 210 is positioned in substantial alignment with the grooves 102, which are on the side opposite to the explosive charge 210. The explosive charge 210 preferably should not extend beyond the periphery 214 of the flexible material 100. Optionally, an adhesive means 218 may be employed to adhere the explosive charge 210 to the flexible material 100 and the flexible material 100 to the target material 520. Initiating means 226 are connected to the explosive charge 210. When the initiating means 226 is activated, the explosive charge 210 creates an explosive force, that is partially focused by the grooves 102. This results in penetration of the target material 520 to create a fragment-free opening 522 formed by a series of four petals 524 cantilevered from the target material 520. The four petals 524 are formed in a position substantially between where the ends 106 of the grooves 102 were positioned, due to the shaping of the explosive force.

The flexible material 100 may be selected by one skilled in the art, however, the material will preferably comprise a flexibility sufficient to be placed against non-flat surfaces, such as sides of barrels or car doors. The material 100 should be of sufficient thickness and possess sufficient hardness to allow the grooves 102 to be scored, machined, molded, or stamped into one side without compromising the stability of the material 100. One preferred thickness comprises 1/16 inch. While almost any shape may be used for the flexible material 100, a shape that is most conducive to an orthogonal pattern for the grooves 102 (discussed in more detail below) is preferable, such as a square. The size of the flexible material 100 is dependent upon the size of the opening that one desires to make in the target material 520. Preferred sizes comprises 4 and 6 inches square. Polymeric materials are preferred for the flexible material such as ABS plastic. Another preferred material comprises a magnetic material that would allow adhesion to a target material 520 that is magnetic in nature without the need for adhesive means 218. An example of such a material is a flexible magnetic sheet material that is a magnetic powder material placed into a thermoplastic base material, manufactured by Magnum Magnetics Corporation.

The width and depth of the grooves 102 may be selected by one skilled in the art depending upon the amount and type of explosive charge 210 used as well as the specific container one desires to open. For most steel based containers, it is preferred that the depth of the grooves comprises the majority of the width of the flexible material 100. For example, for a 1/16 inch wide flexible material, a preferred groove depth comprises approximately 0.06 inches. The shape of the grooves 102, preferably comprises a V-shape in order to best focus the force created by the explosion. Preferably, the angle 120 of the V-shape comprises approximately 45 degrees. The grooves 102 may be placed in the flexible material by many methods known in the art including, for example, an engraving machine or stamping with a press. The grooves 102 must cross one another and where the ends 106 of the grooves are placed upon the flexible material 100 determines the size of the opening made in the target material 520. In order to minimize end effect stresses at the apexes of the forming petals 524, it is preferred that the grooves 102 comprise orthogonal positions to one another, making an X-shape having angles of about 90 degrees between the grooves. Further, it is preferable that the grooves 102 do not extend to the periphery of the flexible material 100. This is in order to help reduce any edge effects from the explosive force that might result in potential fragmentation. Typically, it is preferred that the grooves 102 remain one-quarter inch or greater from the periphery 214 of the flexible material 100.

The explosive charge 210 can be selected by one skilled in the art based upon the amount of force desired by the user of the device. Preferably, the explosive charge 210 will be in the form of a sheet explosive that can be cut to a desired size. A preferred type of explosive material comprises pentacrythritol tetranitrate (PETN). Exemplary explosive charges 210 are 0.043 inch thick and 0.083 inch thick PETN sheet explosives manufactured by E.I. DuPont. The explosive charge 210 is shaped to be placed directly behind the grooves 102. Therefore, the preferred shape of the explosive charge 210 is an X-shape. The thickness of the segments 216 that make up the X-shape may be selected depending upon the force desired from the explosive force. One preferred segment 217 thickness for a PETN sheet explosive comprises about 0.5 inches. The explosive charge 210 should preferably be placed so the grooves 102 are approximately along the center of each segment 216. In order to prevent edge effects, as discussed above, the explosive charge 210 should not extend beyond the periphery of the flexible material 100. It is preferred that the explosive charge 210 not extend beyond the grooves 102, preferably being one-quarter inch or greater from the periphery 214 of the flexible material 100. In one preferred embodiment of the invention, the ends 219 of each segment 216 may be tapered in order to decrease edge effects as discussed above.

The initiating means 226 may comprise any type of explosive initiator that will reliably initiate the type of explosive material used as explosive charge 210. Preferably, the initiating means will be located approximately in the center of explosive charge 210. One preferred initiating means comprises an electric blasting cap because such a device is standard equipment in a bomb disposal technician's kit.

Figure 6:
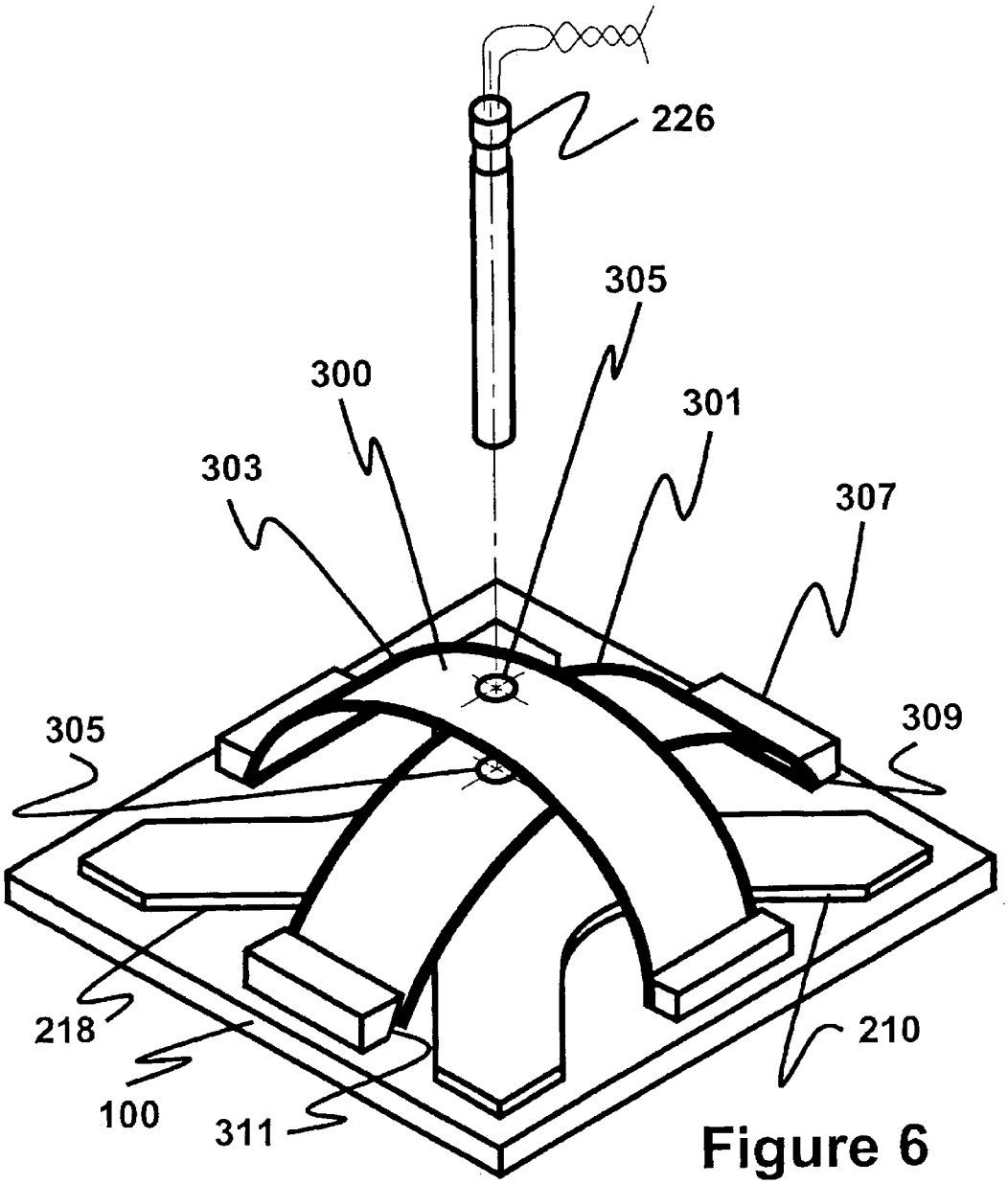
FIG. 6 is a top view of a detonator holder used in the present invention.

Referring to FIG. 6, the invention may also include a holder 300 in order to hold the initiating means 226 in place against the explosive charge 210. A lower spring clip 301 and an upper spring clip 303 with apertures 305, located proximately central to the explosive charge 210, position initiating means 226. The spring clips 301 and 303 are held in place by four positioning tabs 307 that are approximately equidistant from the center of the flexible material 100 and held in position with respect to the flexible material 100 by a strong adhesive means 309. The positioning tabs have a surface 311 that is inclined to capture the ends of spring clips 301 and 303 which are compressed towards each other by said tab surfaces 311. Alignment of the spring clips 301 and 303 with said positioning tabs 311 will centrally locate initiating means 226 with respect to the explosive charge 210. The spring clips may be of a non-metallic material to minimize fragmentation around the target. The adhesive means 218 may be any substance that can hold the explosives 210 against the flexible material 100 and the device against a target material. Preferably, the adhesive means 218 comprises regular adhesive tape because it is inexpensive, can reliably hold the relatively light device in place, and minimize fragmentation around the target.

Figure 3:
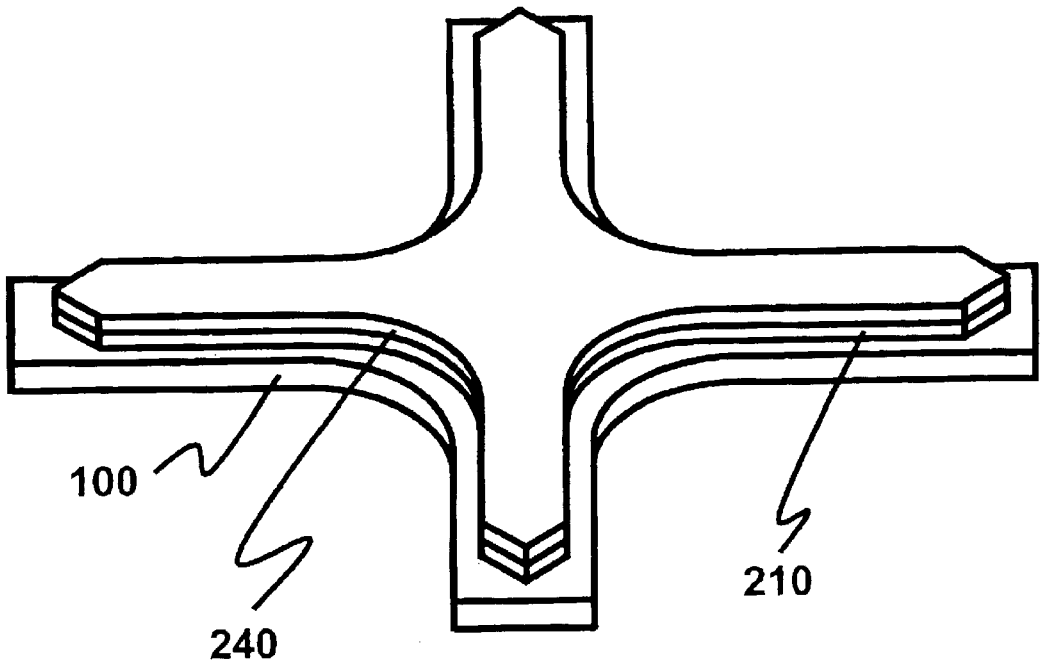
FIG. 3 is a top view of one side of a separate embodiment of the present invention.

Referring to FIG. 3, another embodiment of the invention is presented. This embodiment of the invention is the same as the embodiments shown in FIGS. 1 and 2 except that the flexible material 100 comprises an X-shape, similar to the shape of the explosive charge 210, that surrounds the grooves 102. If certain types of materials are used within the device, as discussed above, and for certain applications, this may be a preferred shape for the flexible material 102. A second material 240 may also be added to the invention to provide increased explosive force, if necessary. This second material 240 would be placed atop the explosive charge 210 and would be shaped similar to the explosive charge 210 or smaller. The second material 240 would not extend to the periphery of the explosive charge 210. Further, the second material 240 preferably would be a frangible type material to avoid fragmentation. The second material 240 could be employed in any configuration of the invention that may require increased explosive force.

Figure 4:
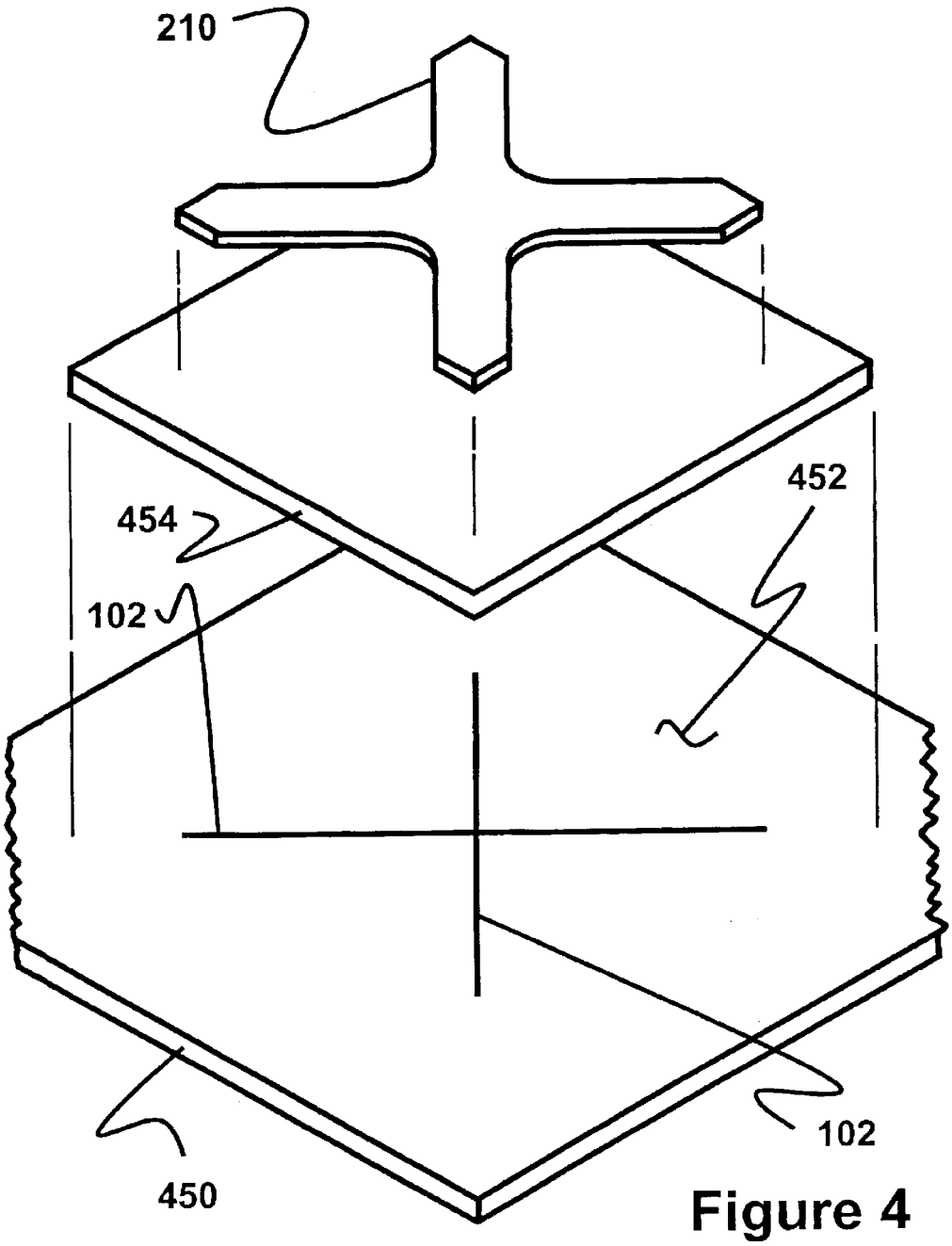
FIG. 4, is a top view of one side of a separate embodiment of the present invention.
Figure 5:
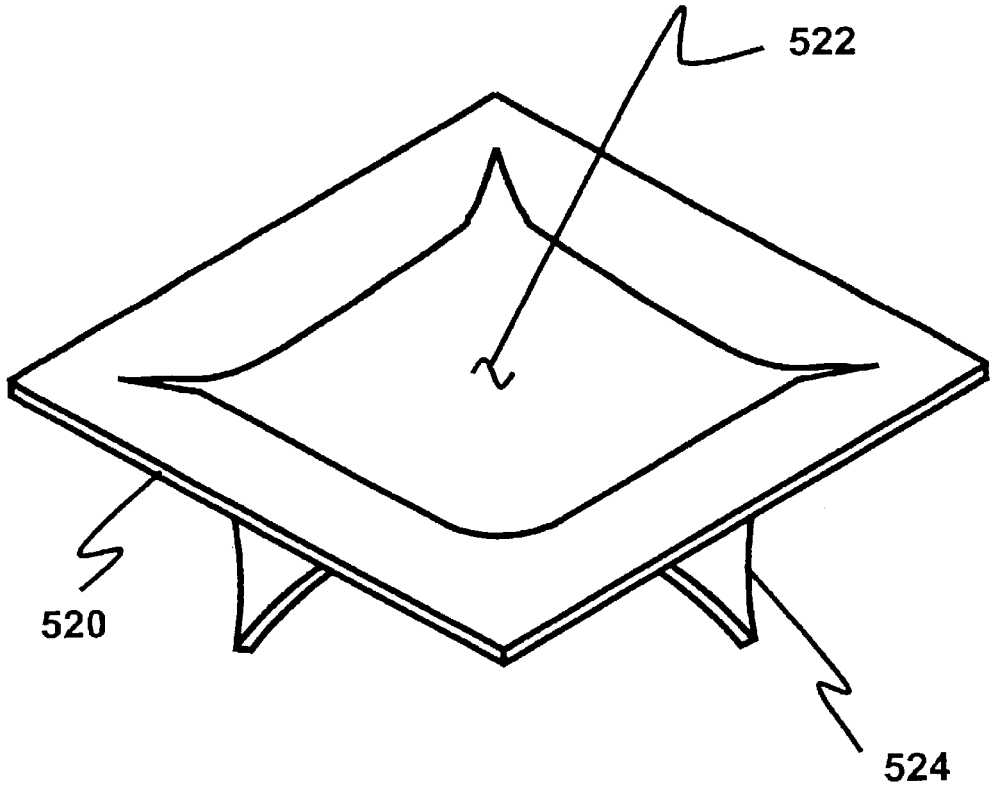
FIG. 5 is a top view of a target after the present invention has been used.

Referring to FIGS. 4–6, yet another embodiment of the invention is presented. This embodiment of the invention, shown primarily in FIG. 4, is designed to create fragment-free openings in "softer" metals, such as aluminum. Present explosive access tools cannot achieve such openings. A cutting plate 450, made of a hard material such as steel or a steel based alloy, has two-crossed deep narrow grooves or pre-punched petal edges 102 formed by a press on a first side 452. As above, the grooves or edges 102 are preferably orthogonal. If the edges are pre-punched, the edges may be heat-treated before being restored to an original flat configuration. A sheet of material 454, being softer than the cutting plate 450, is placed atop the grooves or edges 102, on the first side 452. In order to align the cutting plate 450 and the sheet of material 454, one may draw lines on the back side of each. The sheet of material 454 is preferably the flexible material discussed above. The explosive charge 210, as described above, is placed atop the flexible material, aligned with the grooves 102. Again, initiating means 226 are used to initiate the explosive charge 210. Upon initiation, the force from the explosive charge 210 cantilevers through the cutting plate 450, creating a plurality of petals 524, that press into the softer metal below and create a second plurality of petals that form a fragment-free opening. Therefore, the cutting plate 450 acts akin to a can-opener to create the opening in the softer metal.

The invention also includes method of creating fragment-free openings in target materials using the above described invention.

What is described are specific examples of many possible variations on the same invention and are not intended in a limiting sense. The claimed invention can be practiced using other variations not specifically described above.

What is claimed is:

1. A device for creating an opening in a target material, having a first hardness, comprising:

a cutting plate, having a second hardness being greater than the first hardness, with orthogonal grooves on a front side;

a sheet of material, having a third harness being less than the second hardness and having a surface area less than a surface area of the cutting plate and having a first and a second sides wherein the first side comprises a position against the front side of the cutting plate, placed upon the front side of the cutting plate with the orthogonal grooves; an explosive charge placed upon the sheet of material, positioned substantially along the orthogonal grooves, only on the second side of the sheet of material;

initiating means, located proximately central to the explosive charge, to initiate the explosive charge, creating an explosive force that creates a plurality of petals cantilevered from the cutting plate that drive into the target material, creating a plurality of petals cantilevered from the target material to define a fragment-free opening in the target material.

2. The device of claim 1, further comprising a second material, placed on top of the explosive charge to provide increased explosive force.

3. The device of claim 1, wherein the flexible material comprises a shape having a center and four extending segments, each segment approximately equidistant from the other.

4. The device of claim 1, wherein the cutting plate comprises a substantially square shape.

5. The device of claim 4, wherein the cutting plate comprises a steel based material.

6. The device of claim 5, wherein the target material comprises an aluminum or steel based material.

7. The device of claim 6, wherein the sheet of material comprises a polymer material.

8. A method of creating an opening in an aluminum or steel based material, comprising the steps of:

placing a first sheet of steel based material on the aluminum or steel based material, the first sheet having substantially orthogonal grooves on a side away from the aluminum or steel based material; placing a second sheet, comprising a polymer material and having a surface area less than a surface area of the first sheet of steel based material and having a first and a second sides wherein the first side comprises a position against the front side of the first sheet, on the side of the first sheet on the grooves; placing an explosive charge on the second sheet, positioned in substantial alignment with the grooves, only on the second side of the second sheet; and initiating the explosive charge to create a fragment-free opening in the aluminum or steel based material formed by edges of the sheet of steel based material punching through the aluminum or steel creating a plurality of petals cantilevered from the aluminum or steel based material.

* * * * *